US008017071B2

(12) United States Patent
Magee, Jr.

(10) Patent No.: US 8,017,071 B2
(45) Date of Patent: Sep. 13, 2011

(54) CORROSION-RESISTANT, COLD-FORMABLE, MACHINABLE, HIGH STRENGTH, MARTENSITIC STAINLESS STEEL

(75) Inventor: John H. Magee, Jr., Reading, PA (US)

(73) Assignee: CRS Holdings, Inc., Wilmington, DE (US)

( * ) Notice: Subject to any disclaimer, the term of this patent is extended or adjusted under 35 U.S.C. 154(b) by 84 days.

(21) Appl. No.: 12/547,998

(22) Filed: Aug. 26, 2009

(65) Prior Publication Data

US 2009/0317283 A1 Dec. 24, 2009

Related U.S. Application Data

(63) Continuation of application No. 11/192,246, filed on Jul. 29, 2005, now abandoned.

(51) Int. Cl.
*C22C 38/20* (2006.01)
*C22C 38/22* (2006.01)
*C22C 38/60* (2006.01)

(52) U.S. Cl. ..... 420/61; 420/41; 420/42; 148/325

(58) Field of Classification Search ..... 148/325; 420/41, 42, 60, 61
See application file for complete search history.

(56) References Cited

U.S. PATENT DOCUMENTS 4,450,006 A * 5/1984 Uyehara et al. ..... 420/40
6,332,934 B2 12/2001 Tanida
6,673,165 B2 * 1/2004 Koga et al. ..... 148/325

FOREIGN PATENT DOCUMENTS

JP 04002745 * 1/1992

OTHER PUBLICATIONS

English translation of Japanese patent 10-018001, Uehara, Jan. 20, 1998.*
Key To Steels, 10 edition 1974, West Germany, Verlag Stahischussel.*

* cited by examiner

*Primary Examiner* — Deborah Yee
(74) *Attorney, Agent, or Firm* — Dann, Dorfman, Herrell and Skillman, P.C.

(57) ABSTRACT

A corrosion resistant, martensitic steel alloy having very good cold formability is described. The alloy has the following weight percent composition.

| | |
|---|---|
| Carbon | 0.10-0.40 |
| Manganese | 0.01-2.0 |
| Silicon | 2.0 max. |
| Phosphorus | 0.2 max. |
| Sulfur | 0.030 max. |
| Chromium | 10-15 |
| Nickel | 0.5 max. |
| Molybdenum | 0.75-4.0 |
| Nitrogen | 0.02-0.15 |
| Copper | 1.5-4.0 |
| Titanium | 0.01 max. |
| Aluminum | 0.01 max. |
| Niobium + Tantalum | 0.10 max. |
| Vanadium | 0.20 max. |
| Zirconium | less than 0.001 |
| Calcium | less than 0.001 |

The balance of the alloy is essentially iron. Nickel and copper are balanced in the alloy such that the ratio Ni/Cu is less than 0.2. A second embodiment of the alloy contains at least about 0.005% sulfur, selenium, or a combination thereof to provide good machinability.

13 Claims, No Drawings

CORROSION-RESISTANT, COLD-FORMABLE, MACHINABLE, HIGH STRENGTH, MARTENSITIC STAINLESS STEEL

REFERENCE TO PRIOR APPLICATION

This application is a continuation of U.S. application Ser. No. 11/192,246, filed Jul. 29, 2005, now abandoned the entirety of which is incorporated herein by reference.

FIELD OF THE INVENTION

This invention relates to martensitic stainless steel alloys, and in particular to a martensitic stainless steel alloy having a composition that is balanced to provide a unique combination of corrosion resistance, cold formability, machinability, and high strength.

BACKGROUND OF THE INVENTION

Many steel components of machines and other devices are machined from bar or rod forms of steel alloys. However, the machining process for making such parts, particularly fasteners, results in significant amounts of wasted material. Therefore, parts that were traditionally machined are now being engineered to be fabricated by cold forming techniques such as cold heading.

The shift to the cold forming of steel parts presents a significant problem when in addition to cold formability, corrosion resistance and high strength are required in the steel parts. Hitherto, when high strength and corrosion resistance are needed in a steel part, precipitation hardenable stainless steels have been used. However, the known precipitation hardenable stainless steels do not provide adequate cold formability because of their high annealed hardness which is typically greater than about 100 HRB. The known martensitic stainless steels, although providing somewhat better cold formability, leave something to be desired with their corrosion resistance. Austenitic and ferritic stainless steels provide better corrosion resistance than martensitic stainless steels, but do not provide the strength needed for many applications. In addition, some cold-formed parts may also require a small amount of machining to achieve their final shape and dimension. The use of free-machining additives can adversely affect other desired properties in cold-formable steel alloys.

In view of the foregoing comments, a need has arisen for a martensitic stainless steel with a combination of high strength, corrosion resistance, and good cold formability that is better than the known cold formable stainless steels. It would also be desirable to have such a steel that provides good machinability without adversely affecting the cold formability of the alloy.

SUMMARY OF THE INVENTION

The drawbacks of the known cold formable stainless steels are solved to a significant degree by a martensitic stainless steel alloy having the following Broad, Intermediate, and Preferred alloy compositions.

| | Broad | Intermediate | Preferred |
|---|---|---|---|
| C | 0.10-0.40 | 0.15-0.30 | 0.20-0.25 |
| Mn | 0.01-2.0 | 0.01-1.0 | 0.01-0.3 |

-continued

| | Broad | Intermediate | Preferred |
|---|---|---|---|
| Si | 2.0 max. | 1.0 max. | 0.75 max. |
| S | 0.030 max. | 0.005-0.020 | 0.007-0.015 |
| Cr | 10-15 | 11.5-14.3 | 13.0-13.8 |
| Ni | 0.5 max. | 0.35 max. | 0.25 max. |
| Mo | 0.75-4.0 | 1.25-3.0 | 1.75-2.5 |
| Cu | 1.5-4.0 | 1.75-3.5 | 2.0-3.0 |
| N | 0.02-0.15 | 0.04-0.10 | 0.05-0.08 |

The balance of the alloy is essentially iron together with usual impurities. Nickel and copper are balanced such that the ratio Ni/Cu is less than 0.2, preferably not more than about 0.15, and better yet, not more than about 0.10.

The foregoing tabulation is provided as a convenient summary and is not intended to restrict the lower and upper values of the ranges of the individual elements for use in combination with each other, or to restrict the ranges of the elements for use solely in combination with each other. Thus, one or more of the ranges can be used with one or more of the other ranges for the remaining elements. In addition, a minimum or maximum for an element of a broad, intermediate, or preferred composition can be used with the minimum or maximum for the same element in another preferred or intermediate composition. Here and throughout this specification the term "percent" or the symbol "%" means percent by weight unless otherwise specified.

DETAILED DESCRIPTION

Carbon is present in this alloy because it benefits the high strength provided by the alloy. Carbon is also beneficial for the good phase balance of the alloy. For those reasons, the alloy contains at least about 0.10%, better yet at least about 0.15%, and preferably at least about 0.20% carbon. Too much carbon results in the excess formation of primary carbides in this alloy which adversely affect the corrosion resistance and the cold formability of the alloy. Therefore, the alloy contains not more than about 0.40% carbon, better yet not more than about 0.30% carbon, and preferably not more than about 0.25% carbon.

Manganese is an element that is beneficial to the phase balance of this alloy because it promotes the formation of austenite and inhibits the formation of ferrite. To that end, the alloy contains up to about 2.0% manganese. In order to obtain the benefit provided by manganese, the alloy contains at least about 0.01% manganese. When sulfur is added to this alloy to benefit its machinability, manganese sulfides can form which adversely affect the corrosion resistance provided by the alloy. Therefore, when more than about 0.005% sulfur is present in the alloy, manganese is restricted to not more than about 1.0% and preferably to not more than about 0.3%. Restricting the formation of manganese sulfides by keeping manganese at such low levels promotes the formation of chromium sulfides which benefit machinability, but do not adversely affect the corrosion resistance provided by this alloy.

A small amount of sulfur can be present in this alloy to benefit the machinability of the alloy when desired or needed. Therefore, when good machinability is needed, the alloy contains at least about 0.005% sulfur and preferably at least about 0.007% sulfur. Too much sulfur adversely affects the hot workability and cold formability of the alloy. Also, as described above, sulfur combines with available manganese to form manganese sulfides which adversely affect the corrosion resistance of the alloy. Therefore, when present, sulfur is limited to not more than about 0.030%, better yet not more than about 0.020%, and preferably not more than about 0.015%. Selenium can be substituted for some or all of the sulfur on a 1:1 weight percent basis because selenium also benefits the machinability of this alloy.

For applications where the best cold formability is needed, sulfur is preferably restricted to not more than 0.010%, better yet to not more than about 0.007%, and for best results, to not more than about 0.005%.

Chromium is present in this alloy to benefit the corrosion resistance provided by the alloy. Accordingly, the alloy contains at least about 10% chromium, better yet at least about 11.5% chromium, and preferably at least about 13.0% chromium. Too much chromium results in the formation of ferrite in the alloy in an amount that adversely affects the corrosion resistance and hot workability of the alloy. Therefore, chromium is restricted to not more than about 15% chromium, better yet to not more than about 14.3% chromium, and preferably to not more than about 13.8% chromium in this alloy.

This alloy contains at least about 0.75% molybdenum because it benefits the corrosion resistance of the alloy, particularly in chloride-containing environments. Preferably the alloy contains at least about 1.25% molybdenum and preferably at least about 1.75% molybdenum for that purpose. Like chromium, molybdenum promotes the formation of ferrite in the alloy and too much ferrite adversely affects the general corrosion resistance and the hot workability of the alloy. Therefore, the alloy contains not more than about 4.0% molybdenum, better yet not more than about 3.0% molybdenum, and preferably not more than about 2.5% molybdenum.

Copper is present in this alloy to benefit the cold formability of the alloy. Copper also helps provide an acceptable phase balance in the alloy and contributes to the machinability of the alloy when sulfur is present. The advantages provided by copper are realized when the alloy contains at least about 1.5%. Preferably the alloy contains at least about 1.75% copper and better yet, at least about 2.0% copper. Too much copper can result in hot shortness in the alloy which adversely affects its hot workability. Therefore, copper is restricted to not more than about 4.0%, better yet to not more than about 3.5%, and preferably to not more than about 3.0% in this alloy.

Up to about 0.5% nickel can be present in this alloy to benefit the phase balance of the alloy. Preferably nickel is restricted to not more than about 0.35% and better yet to not more than about 0.25% because nickel increases the annealed strength of the alloy which adversely affects its cold formability. In order to provide a good combination of low annealed hardness, which is essential for good cold formability, and proper phase balance, which is beneficial for corrosion resistance and hot workability, nickel and copper are balanced in this alloy such that the ratio of nickel to copper (Ni/Cu) is preferably less than 0.2, better yet, not more than about 0.15, and preferably, not more than about 0.10.

This alloy contains at least about 0.02% nitrogen, better yet at least about 0.04% nitrogen, and preferably at least about 0.05% nitrogen because nitrogen contributes to the high strength provided by the alloy. Nitrogen also benefits the phase balance and the corrosion resistance provided by this alloy. Too much nitrogen in the alloy results in blowy ingots and adversely affects the cold formability and hot workability of the alloy. Therefore, nitrogen is restricted to not more than about 0.15%, better yet to not more than about 0.10% nitrogen, and preferably to not more than about 0.08% nitrogen.

Silicon can be present in this alloy in an amount that is effective to deoxidize the alloy during melting. However, too much silicon promotes the formation of excess ferrite in the alloy which adversely affects the corrosion resistance and the hot workability of the alloy. Therefore, the alloy may contain up to about 2.0% silicon for use as a deoxidizer. However, silicon is preferably limited to not more than about 1.0%, and better yet to not more than about 0.75% in this alloy.

The balance of the alloy is iron except for the usual impurities and additives found in similar grades of martensitic stainless steel alloys intended for the same or similar use or service. In this regard the alloy contains up to about 0.2% phosphorus, better yet up to about 0.1%, and preferably not more than about 0.05% phosphorus. Also, the alloy contains up to about 0.20%, but preferably not more than about 0.10% vanadium. Up to about 0.10%, preferably not more than about 0.01% of niobium and tantalum combined can be present in this alloy. Further, the alloy contains less than about 0.01% each of titanium, aluminum, and zirconium. The alloy may contain up to about 0.003% boron. Small, trace amounts, typically less than 0.001% each of calcium and zirconium may also be present in the alloy.

No special techniques are required for melting and refining this alloy. Arc melting followed by argon-oxygen decarburization (AOD) can be used. However, vacuum induction melting (VIM) is preferred when better alloy cleanness is needed. This alloy is suitable for use in continuous casting processes and, when desired, can be made by powder metallurgy techniques. After being cast, an ingot of this alloy is preferably furnace cooled at a rate that is slow enough to prevent ingot cracking.

An ingot of the alloy according to the present invention is preferably hot worked from a furnace temperature of about 2000-2300° F. (1093-1260° C.), preferably about 2100-2250° F. (1149-1232° C.), with reheating as necessary after intermediate reductions. In large section sizes, the alloy is hot worked to size in which it can be hot rolled to a cross-sectional dimension in which it can be cold drawn. Intermediate anneals are carried out at about 1650-1700° F. (900-927° C.) for about 4 hours followed by a furnace cool preferably at about 30 F.° per hour to 1200° F. (649° C.). The alloy is then cooled in air to room temperature.

The alloy is preferably hot rolled to a cross-sectional dimension that is suitable for cold drawing. Hot rolling is preferably conducted from a starting temperature of about 2150-2250° F. (1177-1232° C.). After hot rolling, the alloy is annealed at about 1450-1550° F. (788-843° C.) for about 2 hours. Preferably, the alloy is furnace cooled at about 20 F.° per hour from the annealing temperature down to about 1200° F. (649° C.) and then air cooled to room temperature.

The alloy is cold drawn to final dimension in one or more passes depending on the amount of reduction needed. Prior to cold drawing, the alloy can be shaved, polished, and precoated. After cold drawing to the desired size, the wire is cleaned to remove residual drawing compound and any other surface contamination. The alloy wire is then annealed with the same or similar cycle described above. The alloy wire can be coated with a surface layer of copper or other coating to prevent galling during cold forming operations.

The alloy is cold formed, as by cold heading, into a desired shape and dimension. Cold formed products include fasteners such as screws, bolts, and nuts. The final product form is hardened by austenitizing it at about 1750-2000° F. (954-1093° C.), preferably at least about 1900° F. (1038° C.) for about 1 hour, followed by quenching. The alloy is preferably heated at the austenitizing temperature in vacuum for about 1 hour and quenched by rapid gas cooling to protect against thermal scaling (oxidation). The alloy can be tempered at about 300-900° F. (149-482° C.) for about 2 hours and then cooled in air.

The alloy of the present invention can be formed into a variety of shapes for a variety of uses. However, the alloy is preferably formed into rod or wire which can be cold formed into useful articles as described above.

It will be recognized by those skilled in the art that changes or modifications may be made to the above-described embodiments without departing from the broad inventive concepts of the invention. It is understood, therefore, that the invention is not limited to the particular embodiments that are described, but is intended to cover all modifications and changes within the scope and spirit of the invention as described above and set forth in the appended claims.

What is claimed is:

1. A corrosion resistant, martensitic steel alloy consisting essentially of, in weight percent, about

| | |
|---|---|
| Carbon | 0.10-0.40 |
| Manganese | 0.01-0.3 |
| Silicon | 1.0 max |
| Phosphorus | 0.2 max |
| Chromium | 10-15 |
| Nickel | 0.25 max |
| Molybdenum | 0.75-4.0 |
| Nitrogen | 0.02-0.15 |
| Copper | 1.75-3.0 |
| Titanium | 0.01 max |
| Aluminum | 0.01 max |
| Niobium + Tantalum | 0.10 max |
| Vanadium | 0.20 max |
| Zirconium | less than 0.001 |
| Calcium | less than 0.001, |

0.007-0.030% of sulfur, selenium, or a combination thereof, and the balance is essentially iron, wherein Ni/Cu is not more than about 0.10.

2. A corrosion resistant, martensitic steel alloy as set forth in claim 1 containing not more than about 14.3% chromium.

3. A corrosion resistant, martensitic steel alloy as set forth in claim 1 containing not more than about 3.0% molybdenum.

4. A corrosion resistant, martensitic steel alloy as set forth in claim 1 containing at least about 0.04% nitrogen.

5. A corrosion resistant, martensitic steel alloy as set forth in claim 2 containing at least about 11.5% chromium.

6. A corrosion resistant, martensitic steel alloy as set forth in claim 1 containing at least about 2.0% copper.

7. A corrosion resistant, martensitic steel alloy consisting essentially of, in weight percent, about

| | |
|---|---|
| Carbon | 0.15-0.30 |
| Manganese | 0.01-0.3 |

-continued

| | |
|---|---|
| Silicon | 1.0 max |
| Phosphorus | 0.1 max |
| Chromium | 11.5-14.3 |
| Nickel | 0.25 max |
| Molybdenum | 1.25-3.0 |
| Nitrogen | 0.04-0.10 |
| Copper | 1.75-3.0 |
| Titanium | 0.01 max |
| Aluminum | 0.01 max |
| Niobium + Tantalum | 0.10 max |
| Vanadium | 0.20 max |
| Zirconium | less than 0.001 |
| Calcium | less than 0.001, |

0.007-0.020% of sulfur, selenium, or a combination thereof, and the balance is essentially iron, wherein Ni/Cu is not more than about 0.10.

8. A corrosion resistant, martensitic steel alloy as set forth in claim 7 containing not more than about 13.8% chromium.

9. A corrosion resistant, martensitic steel alloy as set forth in claim 7 containing at least about 2.0% copper.

10. A corrosion resistant, martensitic steel alloy as set forth in claim 7 containing not more than about 2.5% molybdenum.

11. A corrosion resistant, martensitic steel alloy as set forth in claim 7 containing at least about 0.05% nitrogen.

12. A corrosion resistant, martensitic steel alloy as set forth in claim 9 containing at least about 13.0% chromium.

13. A corrosion resistant, martensitic steel alloy consisting essentially of, in weight percent, about

| | |
|---|---|
| Carbon | 0.20-0.25 |
| Manganese | 0.01-0.3 |
| Silicon | 0.75 max |
| Phosphorus | 0.05 max |
| Chromium | 13.0-13.8 |
| Nickel | 0.25 max |
| Molybdenum | 1.75-2.5 |
| Nitrogen | 0.05-0.08 |
| Copper | 2.0-3.0 |
| Titanium | 0.01 max |
| Aluminum | 0.01 max |
| Niobium + Tantalum | 0.10 max |
| Vanadium | 0.20 max |
| Zirconium | less than 0.001 |
| Calcium | less than 0.001, |

0.007-0.015% sulfur, selenium, or a combination thereof, and the balance is essentially iron, wherein Ni/Cu is not more than 0.10.

* * * * *